US005206132A

United States Patent [19]

Mitsuhashi

[11] Patent Number: 5,206,132

[45] Date of Patent: Apr. 27, 1993

[54] DIRECT POSITIVE SILVER HALIDE PHOTOGRAPHIC LIGHT-SENSITIVE MATERIAL

[75] Inventor: Tsuyoshi Mitsuhashi, Tokyo, Japan

[73] Assignee: Konica Corporation, Tokyo, Japan

[21] Appl. No.: 695,697

[22] Filed: May 3, 1991

[30] Foreign Application Priority Data

May 14, 1990 [JP] Japan ..... 2-123714

[51] Int. Cl.[5] ..... G03C 1/36

[52] U.S. Cl. ..... 430/567; 430/547; 430/596; 430/597; 430/598; 430/606; 430/963

[58] Field of Search ..... 430/567, 547, 596, 597, 430/606, 598, 963

[56] References Cited

U.S. PATENT DOCUMENTS 4,495,274 4/1985 Toshida ..... 430/597
4,910,130 3/1990 Ogi et al. ..... 430/606
4,952,490 8/1990 Takada et al. ..... 430/567
4,983,508 1/1991 Ishiguro et al. ..... 430/567
5,045,443 9/1991 Urabe ..... 430/567

*Primary Examiner*—Charles L. Bowers, Jr.
*Assistant Examiner*—Thorl Chea
*Attorney, Agent, or Firm*—Finnegan, Henderson, Farabow, Garrett & Dunner

[57] ABSTRACT

A direct positive silver halide photographic light-sensitive material which is improved in gradation and suitable for rapid processing comprises a support having thereon a silver halide emulsion layer containing surface-fogged type direct positive silver halide grains, wherein said direct positive silver halide emulsion layer comprises two or more silver halide emulsions substantially different in sensitivity and/or gradation; the ratio of the total area of (111) face to and total surface area of grains in said emulsions is not less than 50%; and the average silver iodide content of grains in said emulsions is not more than 5 mol%.

5 Claims, No Drawings

DIRECT POSITIVE SILVER HALIDE PHOTOGRAPHIC LIGHT-SENSITIVE MATERIAL

FIELD OF THE INVENTION

The present invention relates to a direct positive silver halide photographic light-sensitive material, particularly to a direct positive silver halide photographic light-sensitive material high in sensitivity, low in fog and excellent in contrast even when subjected to rapid processing.

BACKGROUND OF THE INVENTION

When a silver halide photographic light-sensitive material is exposed to light to which it is sensitive and developed, the black density of the light-sensitive material generally increases with the increase of exposure and reaches a maximum value at a certain exposure, and a further increase in exposure decreases the black density. This phenomenon is called solarization.

Therefore, when an appropriate fog is optically or chemically given beforehand to a silver halide emulsion so as to yield a maximum black density, solarization is caused by exposure, making a positive image directly. A light-sensitive material utilizing such a reversal phenomenon is called a direct positive silver halide photographic light-sensitive material of latent image destruction type (hereinafter referred to as a direct positive light-sensitive material).

Direct positive light-sensitive materials of this type are used, for example, in copying photographs of various types.

Conventional direct positive light-sensitive materials of this type have some problems to be solved. One of the problems is a difficulty in imparting an appropriate high sensitivity to these light-sensitive materials. That is, conventional light-sensitive materials of this type mostly use a silver halide emulsion having a wide grain size distribution, and every silver halide grain does not undergo an optimum chemical sensitization constantly, thereby the inherent sensitivity of these silver halide grains is not brought out fully.

Another problem arises from an increasing demand for rapid processing in recent years. That is, with the rapid expansion of silver halide photographic light-sensitive material consumption, the number of light-sensitive materials to be developed increases markedly. Accordingly, more rapid processing, or more increase in processing volume in a fixed period of time, has come to be strongly demanded. This tendency is seen in various end uses of light-sensitive materials. In light-sensitive materials for X-ray photography, for example, strict enforcement of periodical medical checks leads to a rapid increase in the number of diagnoses, and more accurate diagnoses lead to increase in the number of checking items, which results in more and more increase in a radiographing frequency and necessitates a more rapid processing.

A more rapid processing is strongly demanded of direct positive light-sensitive materials, too; therefore, it is necessary to impart a rapid processability to these light-sensitive materials, in addition to the automatization of diagnoses (in radiographing, conveying, etc.).

However, direct positive light-sensitive materials have a disadvantage that they tend to lower the sensitivity when subjected to a rapid processing in which the overall processing time is not less than 20 seconds and not more than 60 seconds.

The lowering in the sensitivity can be prevented by increasing the coating amount of silver halide emulsion, but this generates the following adverse effects, excluding a rise in film cost as a natural consequence.

(a) insufficient fixation, (b) insufficient film washing, and (c) insufficient film drying.

Therefore, in imparting a rapid processability to the direct positive light-sensitive material, it is necessary to develop a technique which does not lower the sensitivity and maximum density even when the coating amount of silver halide is decreased. Examples of the techniques to impart a high sensitivity with a reduced amount of silver halide can be seen in U.S. Pat. Nos. 2,996,382 and 2,178,382, in which silver halide grains of surface latent image type are allowed to adjoin silver halide grains having fogged specks inside of the grains in order to provide a light-sensitive material having a high sensitivity, sharp contrast and high covering power.

However, these techniques alone cannot impart an appropriately high maximum density and appropriately low minimum density constantly, and preventives against such a problem are apt to deteriorate the sensitivity and contrast.

That is, problems such as a high minimum density (fog) and poor graininess arise when said light-sensitive materials are subjected to a rapid processing in an automatic developing machine whose overall processing time (including crossover time) is not less than 60 seconds and not more than 120 seconds. Addition of various additives to an emulsion or a developer is known as a preventive measure against such a low minimum density, but any of the additives more or less deteriorates the sensitivity, contrast and graininess. Use of gelatin in an increased amount is known as a means to improve the graininess, but it has a defect to lower the sensitivity, gamma and maximum density.

As described above, conventional techniques cannot provide fully satisfactory photographic characteristics including appropriate maximum and minimum densities, a high sensitivity and an sufficient contrast.

SUMMARY OF THE INVENTION

The object of the present invention is to solve the problems described above and to provide a direct positive silver halide photographic light-sensitive material suitable for a very rapid processing and having a high sensitivity, sufficient contrast and low fog (minimum density).

Constitution of the Invention

Taking notice of the actual circumstances described above, the present inventors have made an intensive study and found that the object of the present invention is attained by a direct positive silver halide photographic light-sensitive material having at least on one side of a support at least one direct positive silver halide photographic emulsion layer, which is characterized by the constitution that said direct positive silver halide emulsion layer contains two or more silver halide emulsions substantially different in sensitivity and/or gradation; that the ratio of the total area of (111) face to the total surface area in grains of said emulsions is not less than 50%; and that the average silver iodide content of grains in said silver halide emulsions is not more than 5 mol %.

This light-sensitive material is suitable for rapid processing and processable by the so-called super-rapid processing which is carried out in an overall processing time of not less than 20 seconds and not more than 60 seconds using an automatic developing machine.

DETAILED DESCRIPTION OF THE INVENTION

The present invention will be hereunder described in detail.

In the direct positive silver halide photographic light-sensitive material of the invention having at least one direct positive silver halide emulsion layer at least on one side of a support, said direct positive emulsion layer contains two or more types of silver halide emulsions substantially different from each other in photographic characteristics, and the sum of (111) faces of silver halide grains contained in said layer accounts for more than 50% of the sum of said grains' whole surface areas, and the silver iodide content of said silver halide grains is not more than 5 mol % on the whole.

It is preferred that at least 70% by number of the total silver halide grains in said direct positive silver halide emulsion layers be regular crystals having no twin planes and that 50% or more of the total surface area of these regular crystals be (111) crystal faces. Such regular crystals having no twin planes are known in the photographic industry. An explanation on twin planes can be seen on page 22 (FIGS. 1 to 9) and page 98 of The Theory of the Photographic Process, 4th edition, edited by T. H. James, published from Macmillan Company (1977).

The silver halide grains used in the invention have an external surface composed of (111) faces and (100) faces, and at least 50%, preferably 70% or more, and more preferably 80% or more, of the total external surface comprises (111) faces.

The determination of a (111) face can be known by examining an electron microphotograph of silver halide grain according to a known method in the industry. Typical crystal forms of the silver halide grains used in the invention are of octahedron, tetradecahedron, etc.

In the invention, silver halide grains contained in the direct positive silver halide emulsion layer have a silver iodide content of not more than 5 mol %. Such silver halide grains may consist of silver iodobromide, silver bromide, silver chloroiodobromide or silver chlorobromide, and may consist preferably of silver iodobromide having a silver iodide content of not more than 2 mol %, silver bromide, silver chloroiodobromide or silver chlorobromide.

In the invention, the direct positive silver halide emulsion layer contains two or more types of silver halide emulsions substantially different in photographic characteristics. The term substantially different in photographic characteristics used here means that among the photographic characteristics including sensitivity, gradation, spectral sensitivity, developability, sharpness, graininess, etc., at least sensitivity and/or gradation are different by emulsion types.

Preferable embodiments of the invention are those which use two to six types of silver halide emulsions different in the above photographic characteristics.

These silver halide emulsions may be all monodispersed ones or all polydispersed ones, or may contain both monodispersed ones and polydispersed ones. In the invention, preferable embodiments are those in which two or more types of emulsions be all monodispersed ones, or those in which at least one of two or more types of emulsions be polydispersed one. The particularly preferred are those in which all the emulsions are monodispersed ones.

In the present specification, monodispersion means that a coefficient of variation for grain size is not more than 0.20. That is, standard deviation S is given by $$S = \sqrt{\frac{\Sigma (r - ri)^2 ni}{\Sigma ni}}$$

and coefficient of variation VC is given by $$VC = \frac{S}{r}$$

where ri represents a size of a silver halide grain, r represents an average grain size, and a coefficient of variation for grain size is given by dividing a standard deviation of grain size by an average grain size. Accordingly, the monodispersion of emulsion in the present specification is defined as $S/r \leqq 0.20$. When the term monodispersion" is used in an ordinary meaning, it signifies to be substantially monodispersed.

Polydispersibility means a state of grain size distribution in which at least 10% by weight or number of grains deviate by 40% from the average grain size, when the average grain size is determined by such a usual method as is reported by Trivelli and Smith on The Photographic Journal, 79, pp. 330–338 (1939).

The term "grain size" used here means a diameter for a spherical silver halide grain and a diameter of a sphere converted in the same volume for a non-spherical grain.

The grain size can be determined as a Stokes' radius with a centrifugal analyzer, or can be measured from an electron microphotograph.

Since the configuration of the silver halide photographic light-sensitive material of the invention is to have at least one direct positive silver halide emulsion layer at least on one side of a support, said direct positive light-sensitive material may have either a multilayered configuration or a single-layered configuration. In the single-layered configuration, two or more types of emulsions are contained in said single layer. In the multilayer configuration, two or more types of emulsions may be contained in one of layers. These two or more types of emulsions may be mixed and then coated, or may be individually coated to give a multilayered configuration.

Emulsion layers may be formed on both sides of a support. In this case, the two or more types of emulsions according to the invention may be coated either on one side or on both sides. In case of such double side coating of the relevant two or more types of emulsions, combination of these emulsions may be either the same or different for both sides.

In the invention, the silver halide grains which constitute a direct positive silver halide emulsion layer may contain an inorganic desensitizer inside of the crystals.

Useful examples of the inorganic desensitizer include water-soluble metal salts of the VIII group of the periodic table such as rhodium salts and iridium salts. These water-soluble salts may be used in an amount of $10^{-8}$ to $10^{-2}$ mol per mol of silver halide. Preferably, they are added as an aqueous solution to an emulsion in the course of silver halide grain formation in an amount of $10^{-8}$ to $10^{-3}$ mol per mol of silver halide.

In the invention, an appropriate fogging is made to a silver halide emulsion by adding a reducing agent and gold compound. A much better fogging can be made by allowing an emulsion to fog in the presence of at least one compound selected from thiosulfates and thiocyanates, or by adding at least one compound selected from thiosulfates and thiocyanates to an emulsion which is fogged beforehand with a reducing agent and gold salt.

Moreover, appropriate reversal characteristics can be imparted to a silver halide emulsion used in the invention by adding a water-soluble iodide before the fogging process. Suitable examples of the water-soluble iodide include an ammonium, potassium, lithium and sodium iodide; the addition amount thereof is preferably 1 to 10 millimol per mol of silver halide. An addition amount within this range gives reversal characteristics better than those obtained by an addition in a smaller amount, and imparts a maximum density more sufficient and more stable in storage than that obtained by an addition in a larger amount.

Fogging conditions can be changed to a large extent; but, pH ranges normally from 5.5 to 9, preferably from 6 to 7; pAg ranges preferably from 6 to 7; and temperature ranges normally from 40° C. to 100° C., preferably from 50° C. to 70° C.

To suspend silver halide grains during a fogging process, hydrophilic colloids such as gelatin is used in an amount of 30 to 200 g per mol of silver halide.

Suitable examples of the reducing agent used to fog are organic reducing agents such as aldehydes including formalin and organic amine compounds including hydrazine, triethylenetetramine, thiourea dioxide and imino-amino-triethylenetetramine, thiourea dioxide and imino-amino-methane sulfonic acid; inorganic reducing agents such as tin(II) chloride; and other reducing agents such as amineborane.

Concentration of a reducing agent used may be altered according to silver halide grains, uses thereof and kinds of the reducing agent, but it is preferably 0.001 to 1.00 millimol per mol of silver halide.

In the invention, monovalent or trivalent water-soluble gold salts are used in general as the gold compound to impart fog. Examples thereof include chloroauric acid, gold thiocyanate, sodium chloroaurate, potassium chloroaurate, potassium bromoaurate, potassium iodoaurate, potassium aurocyanide, potassium aurothiocyanide, sodium aurothiomalic acid and gold thioglucose.

The addition amount of these gold compounds is varied by size, composition and uses of silver halide grains, but it is generally 0.0001 to 0.1 millimol, and preferably 0.005 to 0.05 millimol per mol of silver halide. When the gold compound is used in a lower concentration within the above range, a better result can be obtained.

Examples of the thiosulfate and thiocyanate used in the invention are sodium thiosulfate, ammonium thiosulfate, potassium thiocyanate, ammonium thiocyanate and complex salts thereof. These compounds are used in an amount of 0.0003 to 10.0 millimols, preferably 0.005 to 0.5 millimol, per mol of silver halide. The addition time of these compounds may be before, during or after fogging the emulsion with the reducing agent and gold compound. The addition amount thereof is varied by the addition time, and a larger amount is generally required when the addition is made after fogging.

There may be added other photographic additives to a direct positive silver halide emulsion which constitutes the light-sensitive material of the invention. As stabilizers, there may be contained the compounds which are described in Japanese Patent Examined Publication Nos. 16053/1974, 12651/1974 and Japanese Patent O.P.I. Publication No. 66828/1973; azaindenes; benzothiazolium compounds; mercapto compounds; or water-soluble inorganic salts of cadmium, cobalt, nickel, manganese or zinc. As hardeners, there may be contained aldehydes such as formalin, glyoxal or mucochloric acid; S-triazines; epoxides; azyridines; or vinylsulfonic acid. As sensitizers, there may be contained polyalkylene oxides or derivatives thereof described in Japanese Patent Examined Publication Nos. 25203/1967, 10245/1968, 13822/1968, 17926/1968, 17927/1968, 21186/1971, 8102/1974 and 8332/1974. Further, color couplers selected from ones described in Japanese Patent Examined Publication Nos. 24910/1970 and 29878/1970 may also be contained. According to a specific requirement, brightening agents, thickeners, preservatives, matting agents may also be contained.

The silver halide emulsion used in the invention may contain, as a protective colloid, a hydrophilic polymer such as gelatin, gelatin derivative, polyvinyl alcohol, polyvinyl acrylate, polyvinyl pyrrolidone, cellulose ether, partially hydrolyzed cellulose acetate, or ethylene-oxide-grafted poly(N-hydroxylalkyl) β-alanine derivative described in Japanese Patent Examined Publication No. 20530/1974. Further, the emulsion may also contain a dispersion-polymerized vinyl polymer as a binder. For example, there may be used, in order to improve physical properties of a coating layer, a polymer latex prepared by emulsion polymerization of unsaturated ethylenic monomers in the presence of a surfactant described in Japanese Patent Examined Publication No. 32344/1974, or a polymer latex obtained by grafting unsaturated ethylenic monomers to a hydroxyl-group-containing polymer in the presence of a cerium salt described in Japanese Patent Examined Publication No. 20964/1974.

Further, a protected developing agent may be contained for reasons of emulsion technique as described in Japanese Patent Examined Publication Nos. 2523/1969 and 9499/1969; a higher fatty acid such as liquid paraffin or an unsaturated higher fatty acid such as stearyl acetoglyceride may also be incorporated in the emulsion in a protected form to improve physical properties of the coating layer; and the color couplers and stabilizers described above may be protected before being added according to a specific requirement.

Besides the above photographic additives, the direct positive silver halide emulsion used in the invention may contain other conventional additives.

Examples of conventional photographic additives can be seen in Research Disclosure Nos. 17643 (1978) and 18716 (1979) as shown below.

| Additives | RD-17643 Page | Class. | RD-18716 Page |
|---|---|---|---|
| Chemical sensitizers | 23 | III | 648 |
| Sensitizing dyes | 23 | IV | 648 right to 649 left |
| Developing accelerators | 29 | X XI | 648 upper right |
| Antifogging agents | 24 | VI | 649 lower right |
| Stabilizers | 24 | VI | 649 lower right |
| Filter dyes | 25 to 26 | VIII | 649 right to 650 left |

-continued

| Additives | RD-17643 Page | Class. | RD-18716 Page |
|---|---|---|---|
| Brightening agents | 24 | V | |
| Hardeners | 26 | X | 651 right |
| Coating auxiliaries | 26 to 27 | XI | 650 right |
| Surfactants | 26 to 27 | XI | 650 right |
| Plasticizers | 27 | XII | 650 right |
| Slipping agents | 27 | XII | |
| Antistatic agents | 27 | XII | 650 right |
| Matting agents | 28 | XII | 650 right |
| Binders | 26 | IX | 651 right |

The support used in the direct positive silver halide photographic light-sensitive material of the invention may be any of the conventional ones including sheets and plates of glass, wood and metal; synthetic and semi-synthetic polymer films such as cellulose acetate, cellulose acetate butylate, cellulose nitrate, polyester, polyamide, polycarbonate and polystyrene; paper; coated baryta paper; and synthetic-polymer-coated paper including polyolefine-coated paper such as polyethylene- or polypropylene-coated paper (polyolefine-coated paper may be subjected to an electron impact treatment to enhance the adhesion to an emulsion).

The direct positive silver halide photographic light-sensitive material of the invention can be developed by a known method used for a light-sensitive material of this type. In developing a black and white light-sensitive material of the invention, there may be used a conventional developer containing one or more of hydroquinone, 1-phenyl-3-pyrazolidone, N-methyl-p-aminophenol and p-phenylenediamine. Other conventional additives may also be used. A color light-sensitive material of the invention may be color-developed by a conventional color-developing method.

A developer containing an aldehyde hardener can also be used in developing the direct positive silver halide light-sensitive material of the invention. For example, a conventional developer containing maleic dialdehyde, glutaraldehyde or sodium bisulfite thereof can be used.

In the present specification, the overall processing time is defined as the period of time required of a light-sensitive material to travel from the first roller at the inlet of an automatic developing machine through the developing, fixing and washing baths up to the final roller at the outlet of the drying section.

The preferred embodiment of the overall processing time is not less than 20 seconds and not more than 60 seconds. The particularly preferred embodiment is within a range of not less than 20 seconds and not more than 50 seconds.

The processing temperature is not more than 60° C., and preferably 20° to 45° C.

An example of the breakdown of the overall processing time is shown below:

| Processing step | Temperature (°C.) | Time (sec) |
|---|---|---|
| Insertion | — | 1.2 |
| Developing + crossover | 35 | 14.6 |
| Fixing + crossover | 33 | 8.2 |
| Washing + crossover | 25 | 7.2 |
| Squeeze | 40 | 5.7 |
| Drying | 45 | 8.1 |
| Total | | 45.0 |

EXAMPLES

The present invention will be explained in detail with the following examples. As a matter of course, however, the scope of the invention is not limited to these examples.

Example 1

Preparation of seed grain A

There was prepared by the double-jet method, under conditions of 60° C., pAg 8.0 and pH 2, an emulsion consisting of cubic silver iodobromide grains having an average grain size of 0.10 μm and a silver iodide content of 2 mol %. After completion of mixing, gelatin in which 90% of amino groups are combined with phenylcarbamoyl groups was added thereto and the mixture was stirred for 3 minutes, then 0.13 g/mol AgX of potassium hydroxide was added to adjust pH to 4.0. After standing and decantating, 2.1 /mol AgX of water kept at 40° C. and 0.25 g/mol AgX of potassium hydroxide were added to adjust pH to 5.8, and stirring was carried on for 5 minutes. Subsequently, pH was adjusted to 4.3 with 1.5 ml/mol AgX of 1.7-N nitric acid, the emulsion was allowed to stand and then decantated. Next, pH was adjusted to 5.8 by adding gelatin and 0.2 g/mol AgX of potassium hydroxide, and the emulsion was dispersed again. Seed grain A was thus obtained. (AgX represents silver halide in the present specification).

Growing (1) from seed grain A

The above seed grain A was dissolved in a gelatin solution kept at 40° C., and then pH was adjusted to 8.0 with ammonia. Rhodium trichloride (Rh compound) and potassium hexachloroiridate (Ir compound) were then added to the solution in amounts shown in Table 1. Two minutes later, 1-N ammoniacal silver nitrate solution and 1-N potassium bromide aqueous solution were added thereto by the double-jet method, while maintaining pH at 8.0 and EAg at the values shown in Table 1.

After completion of mixing, pH was reduced to 6.0 with acetic acid. Then, desalting was carried out in a similar manner as in preparation of seed grain A. Emulsion Nos. E-1 to E-5, E-9 to E-12 and E-16 to E-18 were thus obtained as shown in Table 1.

Growing (2) from seed grain A

Emulsion Nos. E-6 to E-8 and E-13 to E-15 were prepared in a similar manner as in growing (1) from seed grain A, except that 1-N mixed aqueous solution of potassium iodide and potassium bromide was used instead of 1-N aqueous solution of potassium bromide. Silver iodide contents of these emulsions after shell formation are shown in Table 1.

| Preparation of comparative emulsion 1 | | |
|---|---|---|
| (a) | Gelatin | 25 g |
| | Potassium iodide | 8 g |
| | Water | 1000 ml |
| (b) | Silver nitrate | 170 g |
| | Aqueous ammonia | equivalent |
| | Water | 300 ml |
| (c) | Potassium bromide | 117 g |
| | Rhodium trichloride | 42 mg |
| | Water | 500 ml |
| (d) | Acetic acid | amount to neutralize to pH 6.5 |

Solution (b) was added to solution (a) at 40° C., and solution (c) was added thereto under stirring over a period of 20 minutes. After ripening the resultant emulsion for 30 minutes, solution (d) was added to neutralize it to pH 6.5.

Preparation of comparative emulsion 2

While stirring 500 ml of 4% gelatin solution at 65° C., 5 ml of 1% rhodium trichloride solution was added thereto, and subsequently 2,000 ml of 0.5-N silver nitrate solution and 1960 ml of 0.5-N potassium bromide solution were added over a period of 100 minutes. Thus, a cubic silver iodobromide emulsion having an average grain size of 0.4 μm was obtained.

The comparative emulsions 1 and 2 were both subjected to desalting in a similar manner as with seed grain A.

Each of the emulsions prepared as above was adjusted to pH 6.8, and 0.3 mg/mol AgX of thiourea dioxide, 1.2 mg/mol AgX of sodium thiosulfate and 2.7 mg/mol AgX of chloroauric acid were added at 60° C. thereto. Then, the emulsion was ripened till an appropriate fog was given.

After completion of ripening, these emulsions were mixed in combinations shown in Table 2, and subsequently the following additives were added to prepare emulsion coating solutions. Each emulsion coating solution was coated on a support in a silver amount of 2.3 g/m$^2$ per side, and a coating solution for protective layer was simultaneously coated thereon in a gelatin amount of 0.98 g/m$^2$ at a speed of 70 m/min, and then dried for 2 minutes and 25 seconds. Thus, light-sensitive material sample Nos. 1 to 20 shown in Table 2 were obtained.

| Composition of emulsion coating solution | |
|---|---|
| Lime-treated ossein gelatin | 51 g |
| 4-Hydroxy-6-methyl-1,3,3a,7-tetrazaindene | 1.2 g |
| Silver halide emulsion (converted into silver) | 0.6 mol |
| 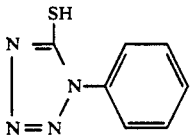 | 0.015 g |
| Nitron | 0.05 g |
| Styrene-butadiene copolymer particles (average particle size: 0.03 m) | 2.5 g |
| Styrene-maleic acid copolymer | 1.5 g |

-continued

| | |
|---|---|
| 2,2-Dihydroxymethyl-1-butanol | 7.0 g |
| 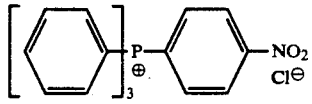 | 8 g |
| Composition of coating solution for protective layer per liter of coating solution | |
| Lime-treated inert gelatin | 68 g |
| Acid-treated gelatin | 2 g |
| 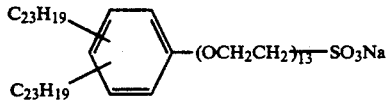 | 1.5 g |
| 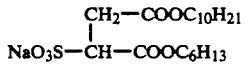 | 1.0 g |
| 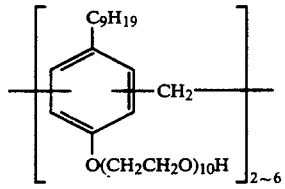 | 1.1 g |
| Ludox AM (colloidal silica, product of DuPont) | 30 g |
| Polymethylmethacrylate particles (matting agent) (projected area average particle size: 3.5 m) | 1.2 g |

The samples prepared as above were each exposed through an optical wedge for sensitometry, processed with a developer XF-DR and fixer XF-SR in an automatic processing machine Model SRX-501 made by Konica Corp. and evaluated for the sensitivity and minimum density. The results are shown in Table 1, where the sensitivity is defined by the reciprocal of an exposure necessary to give an optical density of 1.0 after deducting the base density and minimum density of the sample, and shown by a value relative to the sensitivity of sample 1 in Table 2 which is set to be 100. In Table 1, the contrast is rated in five grades from 1 (excellent) to 5 (bad) by visually observing images of each sample.

As apparent from Table 2, the samples according to the invention are low in fog, high in sensitivity and capable of forming images of good contrast.

TABLE 1

| Emulsion No. | Ir compound (millimol/mol AgX) | Rh compound (millimol/mol AgX) | EAg (mV) during growing-stage | Average grain size (μm) | AgI content (mol %) | Proportion of (111) faces (%) | Relative sensitivity | Contrast |
|---|---|---|---|---|---|---|---|---|
| E-1 | 0.24 | — | 100 | 0.3 | 0.22 | 40 | 60 | 5 |
| E-2 | 0.24 | — | 30 | 0.3 | 0.22 | 65 | 80 | 5 |
| E-3 | 0.24 | — | −10 | 0.3 | 0.22 | 85 | 100 | 5 |
| E-4 | 0.12 | 0.12 | −10 | 0.3 | 0.22 | 85 | 100 | 5 |
| E-5 | — | 0.24 | −10 | 0.3 | 0.22 | 85 | 90 | 5 |
| E-6 | 0.24 | — | 100 | 0.3 | 10.0 | 40 | 50 | 3 |
| E-7 | 0.24 | — | 30 | 0.3 | 6.0 | 65 | 60 | 4 |
| E-8 | 0.24 | — | −10 | 0.3 | 10.0 | 85 | 70 | 3 |
| E-9 | 0.24 | — | 100 | 0.5 | 0.016 | 40 | 200 | 5 |
| E-10 | 0.24 | — | −10 | 0.5 | 0.016 | 85 | 280 | 4 |
| E-11 | 0.12 | 0.12 | −10 | 0.5 | 0.016 | 85 | 300 | 4 |
| E-12 | — | 0.24 | −10 | 0.5 | 0.016 | 85 | 280 | 5 |
| E-13 | 0.24 | — | −10 | 0.5 | 3.0 | 85 | 260 | 5 |
| E-14 | 0.24 | — | −10 | 0.5 | 6.0 | 85 | 180 | 4 |
| E-15 | 0.12 | 0.12 | −10 | 0.5 | 10.0 | 85 | 190 | 3 |
| E-16 | 0.24 | — | −10 | 0.2 | 0.25 | 85 | 30 | 5 |
| E-17 | 0.24 | — | −10 | 0.4 | 0.063 | 85 | 210 | 5 |

TABLE 1-continued

| Emulsion No. | Ir compound (millimol/mol AgX) | Rh compound (millimol/mol AgX) | EAg (mV) during growing-stage | Average grain size (μm) | AgI content (mol %) | Proportion of (111) faces (%) | Relative sensitivity | Contrast |
|---|---|---|---|---|---|---|---|---|
| E-18 | 0.24 | — | −10 | 0.6 | 0.001 | 85 | 310 | 5 |

TABLE 2

| Sample No. | Emulsion No. and mixing ratio (by weight) | proportion of (111) faces (%) | Average AgI content (%) | Fog (minimum density) | Relative sensitivity | Contrast | Remarks |
|---|---|---|---|---|---|---|---|
| 1 | Comparative emulsion 1 | 40 | 4.8 | 0.08 | 100 | 4 | Comparison |
| 2 | Comparative emulsion 2 | 0 | 2.0 | 0.09 | 90 | 4 | Comparison |
| 3 | E-1 | 40 | 0.22 | 0.03 | 60 | 5 | Comparison |
| 4 | E-12 | 85 | 0.016 | 0.01 | 280 | 5 | Comparison |
| 5 | E-1:E-9 = 3:7 | 40 | 0.077 | 0.03 | 114 | 3 | Comparison |
| 6 | E-2:E-9 = 3:7 | 47.5 | 0.077 | 0.03 | 123 | 3 | Comparison |
| 7 | E-2:E-10 = 4:6 | 77 | 0.098 | 0.00 | 180 | 1 | Invention |
| 8 | E-3:E-13 = 4:6 | 85 | 1.89 | 0.02 | 173 | 1 | Invention |
| 9 | E-4:E-11 = 4:6 | 85 | 0.098 | 0.00 | 207 | 1 | Invention |
| 10 | E-5:E-12 = 4:6 | 85 | 0.098 | 0.01 | 211 | 1 | Invention |
| 11 | E-3:E-12 = 5.5:4.5 | 85 | 0.128 | 0.00 | 182 | 1 | Invention |
| 12 | E-3:E-10 = 5:5 | 85 | 0.118 | 0.00 | 196 | 2 | Invention |
| 13 | E-3:E-12 = 6:4 | 85 | 0.138 | 0.01 | 189 | 1 | Invention |
| 14 | E-4:E-10 = 5.5:4.5 | 85 | 0.128 | 0.00 | 195 | 1 | Invention |
| 15 | E-5:E-10 = 3:7 | 85 | 0.077 | 0.01 | 203 | 1 | Invention |
| 16 | E-6:E-14 = 4:6 | 67 | 7.6 | 0.06 | 130 | 1 | Comparison |
| 17 | E-6:E-15 = 4:6 | 62.5 | 10.0 | 0.08 | 117 | 2 | Comparison |
| 18 | E-7:E-14 = 4:6 | 77 | 6.0 | 0.07 | 104 | 1 | Comparison |
| 19 | E-8:E-14 = 3.5:6.5 | 85 | 7.4 | 0.09 | 132 | 1 | Comparison |
| 20 | E-16:E-17:E-18 = 1.5:6.5:2 | 85 | 0.079 | 0.01 | 187 | 1 | Invention |

What is claimed is:

1. A direct positive silver halide photographic light-sensitive material comprising a support having thereon a silver halide emulsion layer containing surface-fogged type direct positive silver halide grains, wherein said direct positive silver halide emulsion layer comprises two or more silver halide emulsions substantially different in sensitivity and/or gradation; the ratio of the total area of (111) face to the total surface area of grains in said emulsions is not less than 50%; the average silver iodide content of grains in said emulsions is not more than 5 mol %; and wherein said photographic material is processed with an automatic processing machine for an overall processing time of more than 20 seconds and less than 60 seconds.

2. A photographic material of claim 1, wherein said area ratio of (111) face is not less than 70%.

3. A photographic material of claim 2, wherein said ratio is not less than 80%.

4. A photographic material of claim 1, wherein said silver iodide content is not more than 2 mol %.

5. A photographic material of claim 1, wherein said silver halide grains contain an inorganic densitizer of rhodium salts and/or iridium salts in an amount of $10^{-8}$ to $10^{-2}$ mol per mol of silver halide.

* * * * *

UNITED STATES PATENT AND TRADEMARK OFFICE

CERTIFICATE OF CORRECTION

PATENT NO. : 5,206,132

DATED : April 27, 1993

INVENTOR(S) : Tsuyoshi Mitsuhashi

It is certified that error appears in the above-indentified patent and that said Letters Patent is hereby corrected as shown below:

Claim 5, column 12, line 38, change "densitizer" to --desensitizer--.

Signed and Sealed this

Fifteenth Day of March, 1994

*Attest:*

Bruce Lehman

BRUCE LEHMAN

*Attesting Officer*

*Commissioner of Patents and Trademarks*